United States Patent [19]

Brinlee

[11] 4,046,117

[45] Sept. 6, 1977

[54] VACUUM SUBJUGATED ACCELERATOR

[76] Inventor: Homer L. Brinlee, 21330 S. Vermont Ave., Torrance, Calif. 90502

[21] Appl. No.: 646,246

[22] Filed: Jan. 2, 1976

[51] Int. Cl.[2] ..... F02D 11/08; G05G 1/14

[52] U.S. Cl. ..... 123/103 C; 123/103 R; 74/513

[58] Field of Search ..... 123/103 C, 103 E, 103 R; 180/108, 109; 74/513

[56] References Cited

U.S. PATENT DOCUMENTS

| | | | |
|---|---|---|---|
| 2,166,866 | 7/1939 | Hansen | 123/103 C |
| 2,585,814 | 2/1952 | McDonald | 123/103 C |
| 2,627,850 | 2/1953 | Willim | 123/103 C |
| 2,825,418 | 3/1958 | Kershman | 123/103 E |
| 2,853,985 | 9/1958 | Landrum | 123/103 C |
| 2,916,885 | 12/1959 | Smith | 123/103 R |
| 3,092,090 | 6/1963 | Berninger | 180/108 |
| 3,133,555 | 5/1964 | Powell | 123/103 R |
| 3,195,525 | 7/1965 | Beck | 123/103 R |

*Primary Examiner*—Carroll B. Dority, Jr.
*Assistant Examiner*—William Randolph
*Attorney, Agent, or Firm*—Huebner & Worrel

[57] ABSTRACT

This invention relates to a vacuum controlled apparatus to be placed between the foot accelerator of a vehicle and a carburetor of an internal combustion engine to regulate the opening of a throttle on the carburetor to maintain a relatively high vacuum in an internal combustion engine for better efficiency. The apparatus additionally effects gasoline savings and restricts the emission of pollutants into the atmosphere through the auto exhaust system. There is a housing containing a vacuum seal means generally controlled by the vacuum from the manifold of an internal combustion engine through an appropriate take-off. Additionally, spring means is associated with and co-act with the seal means to assist in the controlled opening of the throttle.

4 Claims, 7 Drawing Figures

VACUUM SUBJUGATED ACCELERATOR

BACKGROUND OF THE INVENTION

In an internal combustion engine it has been found that where there is a direct linkage between the foot accelerator and the carburetor of such engine there is a tendency to over accelerate causing an excess flow of fuel to the carburetor and reduction of vacuum, thus rendering the internal combustion engine less efficient. Particularly is this true when the vehicle moves from a stopped idle position.

In the past there have been some forms of control mechanism inserted between the foot accelerator and the throttle to control the flow of fuel to the carburetor. These have ranged from various items such as a vacuum control brake means for governing acceleration as found in U.S. Pat. No. 2,157,652, throttle control devices such as found in U.S. Pat. No. 3,769,951 and even to the point of throttle resistors placed adjacent the foot accelerator such as found in U.S. Pat. No. 3,872,739.

However, none of these devices possess the internal structure of the present invention wherein the movement of the linkage between the foot accelerator and the carburetor throttle is controlled by means of a vacuum taken from the manifold of an internal combustion engine to assure a high vacuum and in turn save gasoline. Additionally, none of these devices are equipped with structure wherein the device itself may be overridden in an emergency where it is necessary to assume complete direct control of the acceleration between the accelerator and the throttle.

SUMMARY OF THE INVENTION

The present invention includes a spring loaded vacuum controlled device in the connecting linkage between a foot accelerator and the throttle of a carburetor of a vehicle with an internal combustion engine whereby the movement of the linkage on the foot accelerator side of the device can shift disproportionately to the shifting of the linkage between the device and the throttle. The disproportionate shifting can vary directly with the amount of vacuum which is applied to the device. In other words, a high vacuum produced through the manifold to the device will maintain the vacuum controlled device in a position whereby there is direct simultaneous movement of the connecting linkage. However, if the drive forces the accelerator down which normally reduces the vacuum, there would be independent rear movement of a portion of the device where the opening of the throttle would not be effected and no drastic vacuum drop is possible.

As an illustration, when a car is normally at a stopped, idle position, the vacuum is about 18 to 20 inches of mercury. However, as the car moves forward from the stop even if the foot accelerator is "floored," the vacuum will be maintained because there is no direct linkage to the throttle causing a 0 vacuum and waste of gas. The rear portion of the device can move rearwardly and as the vacuum increases the forward section of the device will move rearwardly which in turn will open the throttle for proper high vacuum acceleration.

The device includes a housing which is inserted in the connecting rod linkage between the foot accelerator to the throttle. One end of the housing is connected to the rod and directly to the throttle and is fixed so that movement of the housing directly opens or closes the throttle. On the other side of the housing the rod is connected to apparatus within the housing whereby depression of the accelerator does not necessarily impart simultaneous movement to the entire housing and rod to the throttle. The movement is controlled by a disc seal attached to the linkage rod adjacent the foot throttle end and a spring member. There is also provided into the housing and chamber created therein a vacuum inlet from the manifold so that there will be a pulling of the disc toward the front end of the housing dependent upon the vacuum which is pulled within the housing. By this play directly proportionate to the vacuum, vacuum drop is prevented controlling a more uniform opening of the throttle and thus there is a savings on gasoline consumption.

Additionally, there is provided a spring override means within the housing which can assist the driver should it be necessary in an emergency to accelerate quickly providing in effect a direct linkage between the foot accelerator and the throttle.

Another advantage of this type of vacuum subjugated accelerator unit is that it may be adapted for interconnection between the foot accelerator and foot throttle whether or not the linkage is that of the type which upon depression of the foot accelerator will cause the linkage to move forwardly to open the throttle or that type of construction in vehicles wherein a depression of the foot accelerator will cause the linkage to move rearwardly which in turn will open the carburetor throttle.

These and other objects and advantages will become apparent from the following description and drawings, wherein:

DETAILED DESCRIPTION OF THE PREFERRED EMBODIMENT

Figure 1:
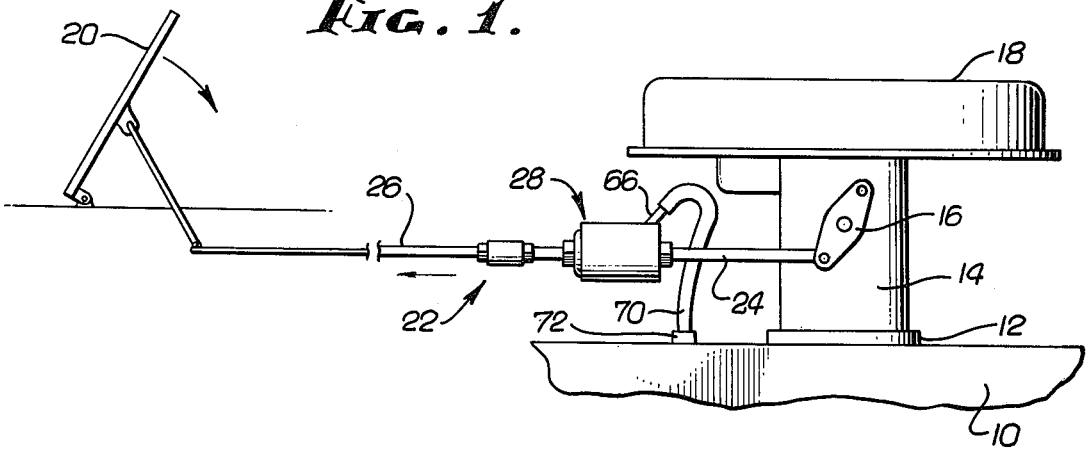
FIG. 1 is an environmental view showing the vacuum subjugated accelerator device in position between a foot accelerator of a vehicle and the carburetor of an internal combustion engine.

There is illustrated in FIG. 1 a fragmented portion of a manifold 10 of an internal combustion engine, not illustrated. Attached to the manifold 10 is a carburetor mount 12, and secured to the mount 12 is a conventional carburetor 14 including a conventional spring throttle 16 which is pivotally mounted and is adapted to control the flow of fuel through the carburetor 14 into the engine.

Mounted atop the carburetor is an air filter 18 which may be of any conventional type.

Connected to the carburetor throttle 16 and extending rearwardly to a foot accelerator 20 is a linking rod means, generally designated 22, which includes a forward rod 24 and a rearward rod 26. Mounted between the rods 24 and 26 is the vacuum subjugated accelerator device, generally designated 28.

In the illustrated embodiment of FIG. 1, the depression of the foot accelerator 20 in the direction of the arrow, through linkage not illustrated, will cause the linking rod 22 to move rearwardly in the direction of the arrows to open the throttle 16.

The details of the vacuum subjugated accelerator unit 28 are shown in FIGS. 2 through 6. There is preferably provided a hollow annular metal housing 36 having an annular inner wall 38, and a forward end 40 and rear end 42. Mounted in the forward end 40 of housing 36 is an annular metal plug 44 adapted to extend into the hollow housing a predetermined distance. The plug 44 is preferably of a diameter approximate the inner diameter of the housing to assure a snug fit. In order to maintain the plug 44 in position a set screw 46 is provided which passes through an opening 48 in the housing into a bore 50 in the plug 44.

The plug 44 includes a threaded bore 52 extending between the plug outer face 54 and inner face 56. The bore 52 is adapted to receive a threaded end 58 of the forward rod 24 of the linking rod means 22. A lock nut 60 is also provided to maintain the rod 24 in a fixed position within the plug 44 when tightened against outer face 54.

As the rod 24 is locked to the plug 44 it can be seen that movement of the rod 24 or housing 36 will directly move the throttle 16, so there is a direct integral movement of the housing and throttle.

The plug 44 also includes a vacuum tube bore 62 which is opposite the set screw 46 and angles upwardly from inner face 56 and is aligned with a bore 64 extending through the wall of the housing 36. Press fitted through bores 64 and 62 is a vacuum tube hollow coupling 66 communicating with a chamber 68 created within the housing 36.

Attached to the hollow coupling 66 is a flexible vacuum tube 70 which extends downward to a vacuum fitting 72 secured in the vacuum manifold 10 as best seen in FIG. 1.

Figure 7:
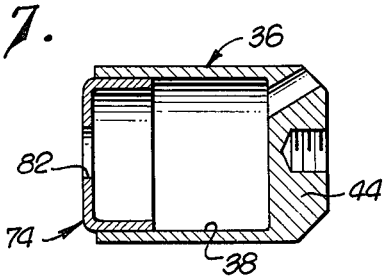
FIG. 7 is a side elevational view in cross section of a modified form of the housing of the vacuum subjugated accelerator.

While the plug 44 has been described as a separate piece of metal it has been found that the housing 36 and end plug 44 may be made as one piece without departing from the spirit of the invention, as illustrated in FIG. 7, so that there is a tubular housing with a forward wall.

Figure 2:
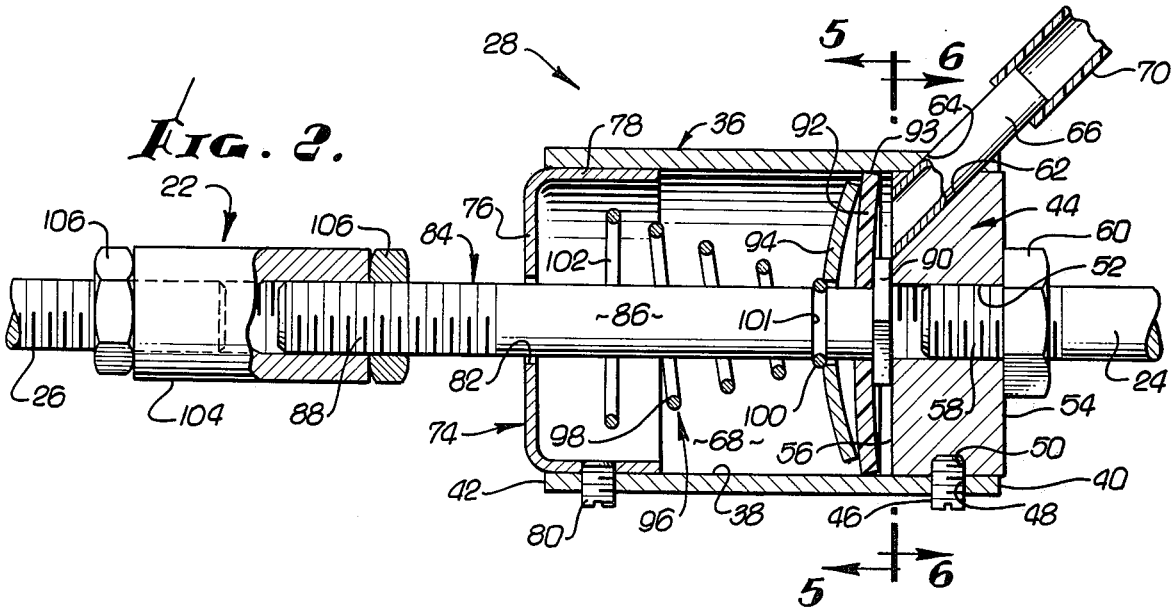
FIG. 2 is an enlarged side elevation cross sectional view of the vacuum subjugated accelerator device in a position it would assume when the engine is off.

At the opposite end 42 of housing 36 there is provided a cap member 74 which as can best be seen in FIG. 2 is preferably dish shaped having an end wall 76 and an annular wall 78 extending normal to the plane of end wall 76.

The diameter of the outer portion of annular wall 78 is complimentary with the inner wall 38 of housing 36 and is press fitted within the housing. A set screw 80 passing through the wall of the housing 36 will assist in maintaining the cap member 74 in place. The positioning of the cap member 74 will complete the closed chamber 68 within the housing 36.

The end wall 76 is also provided with a central opening 82 extending therethrough.

Mounted within the chamber 68 and extending rearwardly through opening 82 is a laterally slidable disc rod 84. The rod 84 is axially aligned with forward rod 24. The rod 84 includes an elongated shank portion 86 having threads 88 at one end and a head 90 at the other end.

It should be noted that the opening 82 is generally larger than the shank portion 86 of rod 84. The reason for this is to allow the escape of air as the shank and rod 84 move rearwardly within the housing 36.

Mounted on the elongated shank 86 and abutting the head 90, when in an at rest position is a disc seal 92. The disc seal 92 is flexible and preferably made of nylon, teflon or other pliable sheet material having a memory and returnable to the position shown in FIG. 2. The diameter of the disc seal 92 is slightly greater than the internal diameter of the chamber 68 so that a drag is created with rearward movement of the disc 92 and rod 84 when the disc is in a vertical profile. Additionally, as seen in FIG. 2 the outer portion of the disc seal is slightly bowed forwardly toward the wall 56 of plug 44.

Rearwardly of the disc seal 92 there is provided a cup shaped fixed disc 94 mounted on the elongated shank 86 and of a diameter less than the internal diameter of the chamber 68.

Rearwardly of the disc seal 92 there is provided a spring means 96 which is preferably a conical concentric coil spring 98 surrounding the rod 84. The forward convolution 100 is preferably secured in an annular groove 101 in the rod 84 and abuts the rear surface of the disc 94, maintaining the same from moving rearwardly on the rod 86. By the perimeter of the fixed disc 94 engaging the rear surface of the disc seal and the head 90 engaging the front surface of the disc seal the assembly is fixed as to movement on the rod 86.

The spring convolution 102, which is remote from convolution 100, does not engage any portion of the housing 36 or end wall 76. When the unit is in an at rest position, see FIG. 2.

In order to attach the disc rod 84 to the rearward linkage rod 26 of the linking rod means 22 a threadable coupling 104 is utilized and lock nuts 106 may be used to assure a locking of rods 26 and 84 for simultaneous movement.

Figure 4:
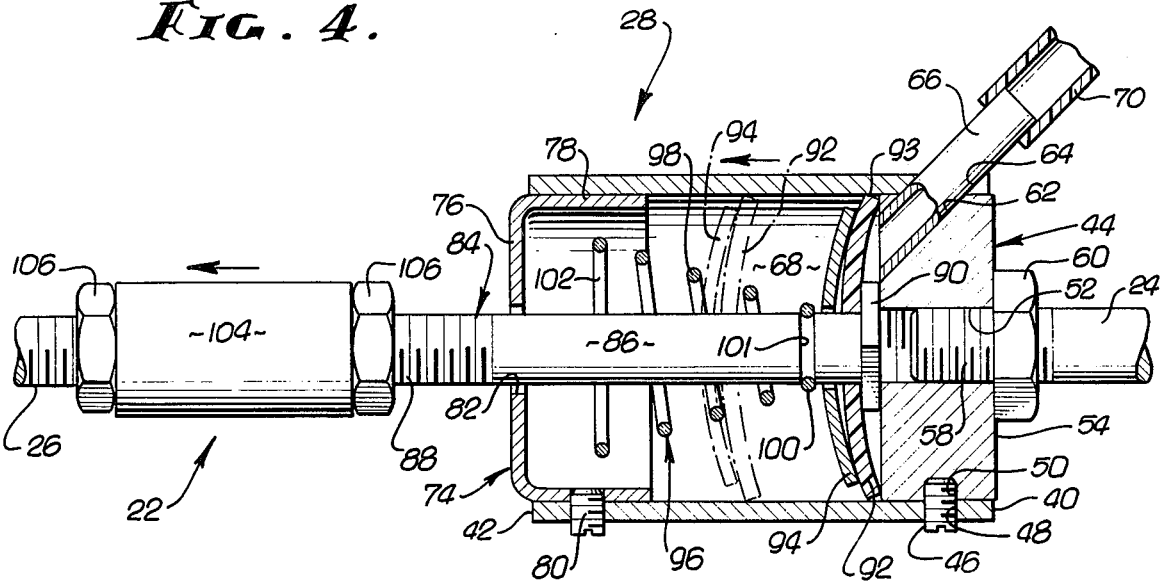
FIG. 4 is again a side elevation cross sectional view similar to FIGS. 2 and 3 showing the position of the interior structure when there is a vacuum created in the manifold, and also ghost positions of the interior structure.
Figure 5:
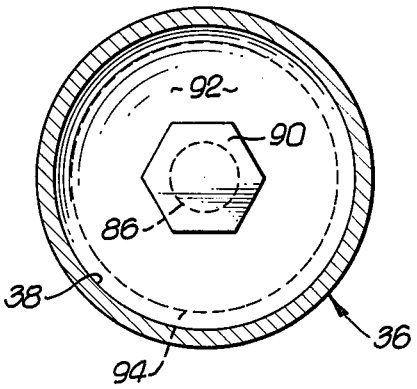
FIG. 5 is a cross sectional view taken on line 5—5 of FIG. 2 showing the internal disc and retention portion of one part of the linkage rod between the foot accelerator and the carburetor throttle.
Figure 6:
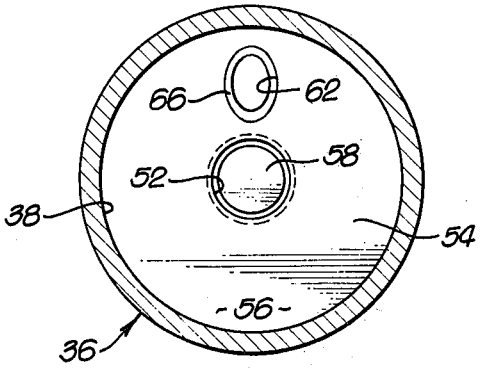
FIG. 6 is a cross sectional view taken on line 6—6 of FIG. 2 in the reverse direction from FIG. 5 showing the vacuum port as well as the opening for the permanent attachment of the linkage rod moving from the vacuum subjugated accelerator device to the carburetor throttle.

When the engine is running a vacuum is created and a position of the disc seal 92 as illustrated in FIG. 4 will be assumed. With a vacuum being drawn through coupling 66, the disc seal 92 as can be seen will be further cupped at its annular periphery so that the annular end is engaging the corner created by wall 56 of plug 44 and the inside wall 38 of housing 36.

This position will move the annular edge 93 of the disc seal 92 from full drag contact with the annular wall 38, best seen in FIG. 2 to a partial corner engagement with wall 38 best seen in FIG. 4. In other words, the diameter of the disc seal 92 is slightly reduced when a vacuum is present.

The position of the disc seal 92 of FIG. 4 is the optimum position where there is normally a high vacuum so that the entire unit 28 will move simultaneously.

However, should the foot accelerator be pushed down and the rod 26 be moved rearwardly in the direction of the arrow, FIG. 4, the disc seal 92 may be moved rearwardly in the housing 36 such as shown in ghost lines of that view. In other words, the vacuum can be overcome, but assuming the emergency phase is not involved, there is no momentary direct movement of the housing or forward rod 24 to flood the carburetor and decrease the engine vacuum. The disc seal 92 will momentarily float in the chamber 68, but because the vacuum has not really been reduced within the chamber 68, the vacuum will draw on the disc 92 but being held by the foot accelerator the housing 36 and in turn rod 24 will move rearwardly to close the gap. This will open the throttle to maintain a contrast high vacuum and the disc seal 92 will again engage wall 56 for direct movement of linkage means and maintenance of the desired higher vacuum.

Therefore, to assure steady driving to increase efficiency and gas mileage, slight foot accelerator push is the optimum so the unit 28 stays in the vacuum locked position of FIG. 4. Any heavy foot action causes a differential of movement so no 0 vacuum is created.

The purpose of the disc plate 94 is to prevent a reversal of the disc seal 92 when the housing moves rearwardly. The arc of the disc is generally complementary with the arc of the disc seal and acts to stabilize the disc seal if any drag is exerted on the peripheral edge 93.

Figure 3:
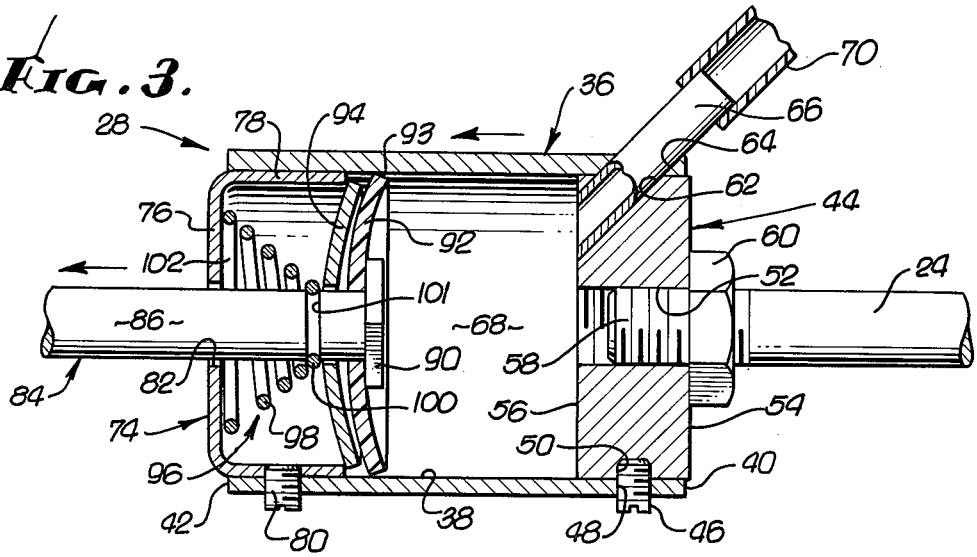
FIG. 3 is a view similar to FIG. 2 which is an enlarged side elevation cross sectional view of the device showing the interior structure wherein there is an override of the device for emergency direct connection.

In FIG. 3 there is illustrated the position of the disc seal 92 and disc plate 94 when the unit 28 is in an emergency situation. If the driver needs to overcome the differential movement, the foot accelerator can be depressed to a point where the rod 26 will be moved rapidly rearwardly causing the disc plate 94 to peripherally engage the edge of wall 78 of cap 74. This will effect a direct movement of the housing 36 and rod 24 rearwardly instantaneously opening the carburetor throttle. The spring 96 as seen in FIG. 3 will be compressed and biased against the cap 74. As the speed of the vehicle increases and then is stabilized the engine will return to a normal high vacuum whereby the spring 96 will assist the draw of the high vacuum to move the housing 36 rearwardly and retain the disc seal 92 to its normal optimum position as shown in FIG. 4.

Although I have herein shown and described my invention in what I have conceived to be the most practical and preferred embodiment, it is recognized that departures may be made therefrom within the scope of my invention.

I claim:

1. A vacuum subjugated accelerator apparatus for use with an internal combustion engine interposed in control linkage between a foot accelerator and carburetor throttle for modulating the flow of gasoline to said carburetor and in turn achieving an optimum vacuum within an intake manifold of said engine for motor efficiency and gas savings comprising:

an annular housing having forward and rearward ends and a horizontal axis, said housing including an end wall closing said forward end of said housing;

a removable cap sealing said rearward end of said housing, said cap having a bore extending therethrough on the horizontal axis of said housing;

said housing, end wall and cap means, defining a vacuum chamber;

coupling means associated with said end wall receiving a portion of said control linkage extending directly to said throttle of said carburetor whereby horizontal movement of said housing will impart direct opening and closing of said throttle;

a vacuum port extending through said end wall communicating with said vacuum chamber adapted to receive tubular means extending from said intake manifold of said engine to said vacuum port to create a vacuum within said vacuum chamber;

a slidable disc rod extending from within said chamber through said bore of said cap means axially aligned on said housing axis, said disc rod coupled to a portion of said control linkage extending directly to said foot accelerator whereby foot depression of said accelerator will impart direct rearward axial movement of said slidable disc rod, said disc rod including an enlarged head portion within said vacuum chamber;

annular flexible disc seal means mounted on said slidable disc rod with the central portion of said flexible disc bearing against said enlarged head of said sic rod;

a disc plate mounted on said disc rod rearwardly of said flexible disc, said plate being dished with a periphery thereof in contact with said flexible disc biasing said flexible disc in a concave position toward said front wall;

spring means including a portion locking said disc plate against said flexible disc and additionally extending rearwardly therefrom toward said cap means;

said flexible disc seal being adapted to be further peripherally curved away from the annular interior of said housing toward said end wall when a higher vacuum is produced through said vacuum port whereby drag on said flexible disc and in turn said disc rod and linkage extending to said accelerator is created yet said disc rod and flexible disc seal being movable from said end wall toward said cap means without directly affecting the opening of said throttle and said flexible disc seal yieldably returnable to a position wherein there is partial contact between said flexible disc and said end wall in an optimum position whereby direct movement of said control linkage and vacuum subjugated accelerator means can be achieved.

2. An apparatus as defined in claim 1 wherein said bore in said removable end cap is larger than the diameter of said slidable disc rod wherein air within said chamber behind said disc plate may be expelled when said disc rod moves rearwardly.

3. A vacuum subjugated accelerator apparatus for use with an internal combustion engine interposed in control linkage between a foot accelerator and carburetor throttle for modulating the flow of gasoline to said carburetor and in turn achieving an optimum vacuum within an intake manifold of said engine for motor efficiency and gas savings comprising:

an annular housing having forward and rearward ends and a horizontal axis, said housing including an end wall closing said forward end of said housing;

a removable cap sealing said rearward end of said housing, said cap having a bore extending therethrough on the horizontal axis of said housing;

said housing, end wall and cap means, defining a vacuum chamber;

coupling means associated with said end wall receiving a portion of said control linkage extending directly to said throttle of said carburetor whereby horizontal movement of said housing will impart direct opening and closing of said throttle;

a vacuum port extending through said end wall communicating with said vacuum chamber and tubular means extending from said intake manifold of said engine to said vacuum port;

vacuum subjugated disc means mounted in said chamber and including a projection extending along the axis of said housing rearwardly through said bore of said cap, said vacuum subjugated disc means axially moveable independently of said housing yet adapted to be yieladable lockable to said end wall by a vacuum created through said vacuum port whereby said housing and said vacuum subjugated disc means can be moved as an integral unit assuring throttle control to effect a high vacuum in said manifold;

coupling means associated with said projection receiving a portion of said control linkage extending to said foot accelerator, whereby excessive depression of said foot accelerator may impart axial movement to aid vacuum subjugated disc means and overcome said vacuum thereby creating said independent movement of said subjugated disc means without affecting the vacuum created in said manifold, said vacuum subjugated disc means further includes an annular flexible disc with a peripheral edge and wherein said disc is dish-shaped and the concave surface faces said end wall and said peripheral edge engages the wall of said chamber, and wherein a dish-shaped disc plate is mounted on said projection rearwardly of said flexible disc biasing said flexible disc in said dish shape.

4. Apparatus as defined in claim 3 wherein there is a spring mounted on said projection rearwardly of said disc plate which is normally in a suspended position yet when said disc means is moved to an extreme rearward position to overcome the vacuum in an emergency situation for direct accelerator to throttle movement said spring will engage said cap means and assist in the return of said disc means including said flexible disc to its normal forward wal contact when the desired speed of said engine has been achieved.

* * * * *